US006456902B1

(12) United States Patent
Streetman

(10) Patent No.: US 6,456,902 B1
(45) **Date of Patent: *Sep. 24, 2002**

(54) WEB-BASED SYSTEM AND METHOD FOR ENHANCING FLUID AND GAS RECOVERY AS WELL AS REMOTE ON DEMAND CONTROL OF FLUID FLOW IN A WELL

(76) Inventor: Foy Streetman, 401Chickasha Ave., Chickasha, OK (US) 73023

( * ) Notice: Subject to any disclaimer, the term of this patent is extended or adjusted under 35 U.S.C. 154(b) by 0 days.

This patent is subject to a terminal disclaimer.

(21) Appl. No.: 09/572,013

(22) Filed: May 16, 2000

Related U.S. Application Data

(63) Continuation-in-part of application No. 09/196,502, filed on Nov. 19, 1998, which is a continuation-in-part of application No. 09/057,039, filed on Apr. 8, 1998, now Pat. No. 5,937,946.

(51) Int. Cl.[7] ..... G05D 7/00; G05D 11/00; E21B 43/00

(52) U.S. Cl. ..... 700/282; 166/267

(58) Field of Search ..... 700/281, 282; 166/105.5, 53, 265, 267

(56) References Cited

U.S. PATENT DOCUMENTS 4,150,721 A 4/1979 Norwood ..... 166/53
4,352,376 A 10/1982 Norwood ..... 137/624.15
5,983,164 A * 11/1999 Ocondi ..... 702/12
6,209,642 B1 * 4/2001 Streetman ..... 166/267

* cited by examiner

*Primary Examiner*—Leo Picard
*Assistant Examiner*—Ryan Jarrett
(74) *Attorney, Agent, or Firm*—R. William Graham

(57) ABSTRACT

An apparatus for enhancing fluid and gas flow recovery as well as remote on demand control of flow in a well includes an upstream flow line communicably connected at one end to the well in a manner to receive fluid and gas therefrom, a fluid and gas separator communicably connected to another end of the upstream flow line in a manner to receive fluid and gas flow therefrom, a downstream sales flow line communicably connected to the fluid and gas separator in a manner to receive gas flow therefrom, a control valve operably disposed in the upstream flow line, a local controller device operably controllably connected to the control valve in a manner to permit regulated flow through the upstream flow line at a predetermined amount and having a communications device associated therewith, and a remote controller device having a communications device therewith, wherein the local controller device and remote controller device communicate with one another to enable remote control of the control valve. Also, a pressure differential control is operably disposed in the downstream sales line for comparatively sensing pressure differential in the downstream sales line about a restricted region in the downstream sales flow line which is also operably controllably connected to the control valve in a manner to permit regulated flow through the upstream flow line at a predetermined amount in response to the sensed pressure differential. A method is also provided.

3 Claims, 8 Drawing Sheets

WEB-BASED SYSTEM AND METHOD FOR ENHANCING FLUID AND GAS RECOVERY AS WELL AS REMOTE ON DEMAND CONTROL OF FLUID FLOW IN A WELL

This is a continuation-in-part of U.S. patent application Ser. No. 09/196,502, filed Nov. 19, 1998 which is a continuation-in-part of U.S. patent application Ser. No. 09/057,039 filed Apr. 8, 1998, now issued as U.S. Pat. No. 5,937,946.

BACKGROUND OF THE INVENTION

1. Field of the Invention

This invention relates to enhanced recovery and on demand remote controllability from a well. More specifically, this invention relates to an improved apparatus that enhances recovery in oil and gas wells by employing regulated flow devices and techniques and optionally in combination the addition of fluid enhancing additives as well as remote controlling of the amount of fluid and gas to a particular user. Further, the invention provides for a web based on demand control of fuel and/or power.

2. Related Art

As was discussed in applicant's copending application U.S. Ser. No. 09/057,039 now U.S. Pat. No. 5,937,946 and co-pending U.S. Ser. No. 09/196,502, each well has its own predetermined optimal recovery conditions which are determined by the natural geological formation of the well. When a successful well is drilled, there is usually enough gas-volume to fluid-ratio and bottom hole pressure to create a natural flow from the well. This ability to flow at a certain velocity to insure fluids are lifted is termed "critical flow rate." The ability to substantially maintain or simulate natural flow conditions is critical in optimizing recovery.

Under the natural flow pressure, fluid flow is created by virtue of the liquid being broken up into small units by gas existing therein and is carried to the surface due to a fluid "lightening" effect under gaseous expansion to achieve critical flow rate. The combined gas and liquid are transferred via an upstream flow line to a fluid/gas separator which is designed to remove the liquid into storage tanks and remove the gas to a downstream sales flow line which commonly connects with a utility service provider at what is more commonly referred to as the pipeline.

Unfortunately, in new tight gas sand wells or older wells having reduced reserve volumes, and pressure in the well depletes during the flow cycle and negatively impacts the optimal recovery conditions and flow needed to achieve critical flow rates. As a result, typically only part of the oil and gas contained in the underground formation by a primary recovery method which uses the natural flow force present in the reservoir is possible. A variety of enhanced recovery techniques such as artificial lift systems, so-called secondary or tertiary recovery methods, have been employed to increase the recovery of oil and gas from subterranean reservoirs.

A common artificial lift, secondary recovery method includes a combination of shutting in the well for a period of time to allow for pressure build up and allowing a plunger to drop to the bottom of the well and then opening the well causing the plunger to drive the fluid to the surface. Another such enhanced recovery technique is to use a pump truck to pump additives into the oil well-bore. These additives can, for example, reduce scale, paraffine and the viscosity of the oil and increase production of oil recovery.

A problem with these prior techniques is the lack of proper control in order to carry out those techniques during initiation and slow down of flow within a well. Also, waste can occur downstream in that metering devices of service providers to which the downstream sales flow line connects do not properly meter or record spikes (temporary large amounts of gas over that recordable by the meter) which occur during the other recovery methods. In this regard, care must be taken to maintain optimal recovery conditions in carrying out other recovery methods.

Applicant's prior said applications are directed at solving a significant part of the aforementioned problems by providing an apparatus which controls the flow within the downstream sales line as well as remote control thereof. There remains a need to improve upon enhancing oil and gas recovery techniques as well as the method such recovered oil and gas is obtained and delivered. There is a further need to improve the method of delivery of fuel to remote users.

BRIEF SUMMARY OF THE INVENTION

It is an object to control well production via a remote control device which is preferably web based.

It is an object of the present invention to further enhance fluid and gas flow in a well.

It is another object to improve the apparatus for enhancing fluid and gas flow in a well.

It is still another object to artificially induce optimal recovery conditions in a well, while maintaining its flow at a measurable rate.

Yet another object is to establish flow patterns which improve the promotion of fluid break up into droplets and thus prevent fluid from falling back into the well during well shut-in periods.

It is another object to improve marketing and delivery of fuel and/or power.

Accordingly in one embodiment, the present invention is directed to an apparatus for enhancing fluid and gas flow in a recovery includes an upstream flow line communicably connected at one end to the well in a manner to receive fluid and gas therefrom. A fluid and gas separator communicably connects to another end of the upstream flow line in a manner to receive fluid and gas flow therefrom. A downstream sales flow line communicably connects to the fluid and gas separator in a manner to receive gas flow therefrom. A control valve is operably disposed in the upstream flow line.

A local controller device operably controllably connects to the control valve in a manner to permit regulated flow through the upstream flow line at a predetermined amount and has a communications device associated therewith. A remote controller device having a communications device therewith is also provided, wherein the local controller device and remote controller device communicate with one another to enable remote control of the control valve. The remote controller device preferably includes a web-based server-client computer system enabling on demand control of fluid and gas flow.

A pressure differential control is operably disposed in the downstream sales line for comparatively sensing pressure differential in the downstream sales line about a restricted region in the downstream sales flow line which is operably controllably connected to the control valve in a manner to permit regulated flow through the upstream flow line at a predetermined amount in response to the sensed pressure differential.

Another aspect of the invention includes the introduction via the remote control of the well production and power via a web-based client-server system. For example, remote control of additives into the well-bore can be added to increase recovery, wherein the additives are activated and controlled by flow patterns established therein. A shut-in timer of the well may be remotely controlled and locally generated power can be controlled and distributed via the present invention.

The invention includes sensors for gathering data corresponding to at least one of weather, chemical requirements, down-hole status, real-time metering, service requirements, and geological characteristics about of the well and well site and transmitting the data to the web-based remote controller. The web-based remote controller includes a receiver and processor for receiving and manipulating the data to produce web-based reports corresponding thereto.

The invention also provides a sensor for sensing flow rate at the well communicating the flow rate to the web-based remote controller which receives and displays the sensed flow rate. Still another sensor is proved at the well site for sensing service requirements and the web-based remote controller has means for receiving and displaying the service requirement. The web-based remote controller automatically initiates a service call. There is also a sensor for sensing security breach at the well and the web-based remote controller has means for receiving and displaying the security breach.

The invention includes third party access operably connected to the web-based remote controller for allowing a third party to access on the web-based remote controller. The third party access can have various levels of predetermined access restrictions. The invention also includes software on the web-based remote controller for generating web-based reports including at least one of bulletin board information, trading information and programs, regulations requirement, geology evaluations, derivatives, reserve studies, and due diligence, post nominations and post to accounting.

A method of the present invention includes the steps of controllably delivering fluid and gas from a well in a single inlet flow path to a separator, separating the fluid from the gas into to separate outlet flow paths from the separator, and remote controllably regulating flow of the fluid and the gas in the inlet path. The remote control preferably includes a web based server-client computer system. The method also includes comparatively sensing pressure of gas about a restricted region of the outflow path, and controllably, preferably remotely, regulating flow rate of the fluid and the gas in the inlet path in response to the sensed pressures and in accordance with a predetermined flow rate. Additionally, the method may include the adding of a flow enhancing additive to the well via remote control.

Other objects and advantages will be readily apparent to those skilled in the art upon viewing the drawings and reading the detailed description hereafter.

DETAILED DESCRIPTION OF THE INVENTION

Figure 1:
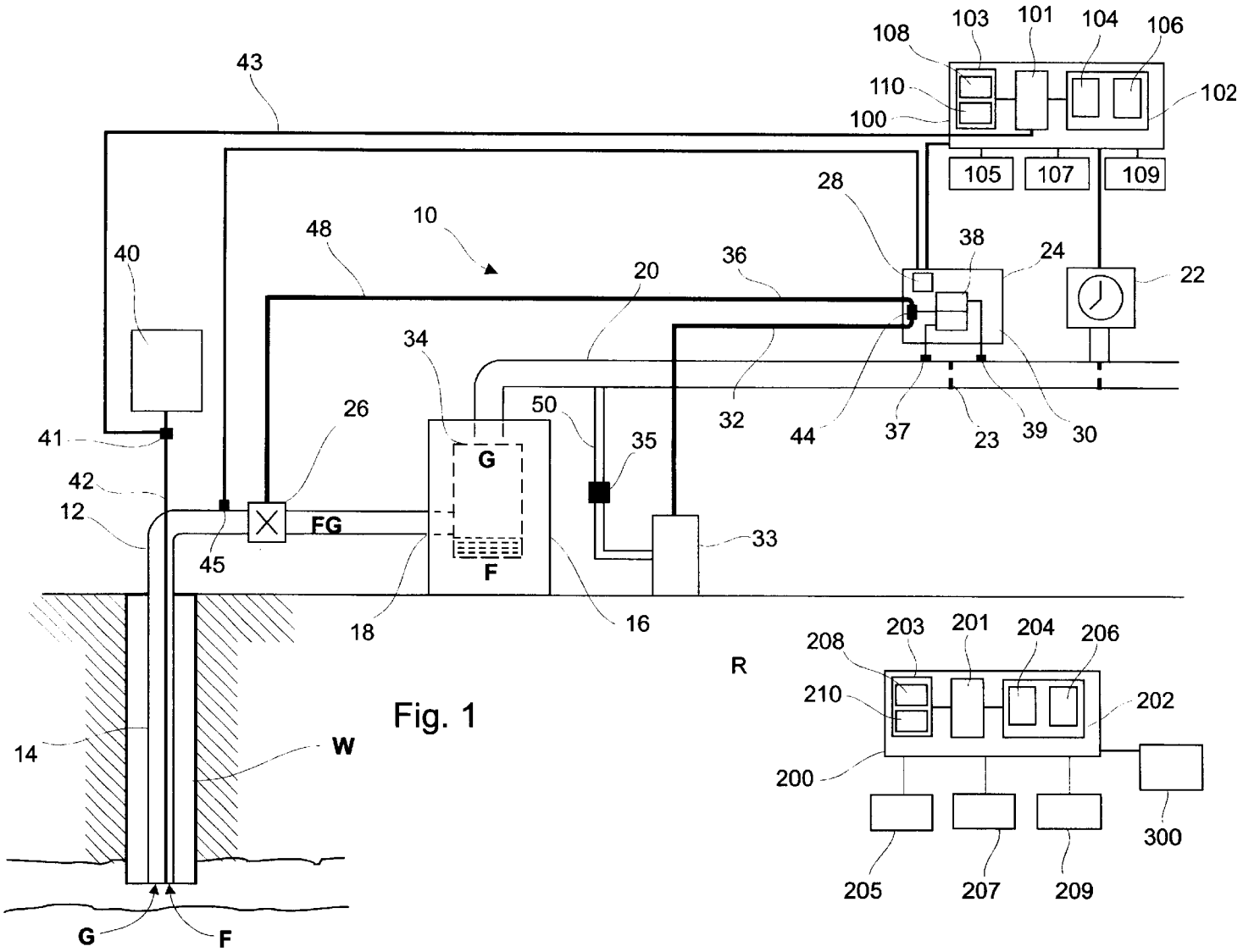
FIG. 1 is a schematic diagram of the present invention.

Referring to the drawings, the apparatus for enhancing fluid and gas recovery and enabling on demand remote control of fluid and gas from a well W of the present invention is generally referred to by the numeral 10. The apparatus 10 includes an upstream flow line 12 communicably connected at one end 14 to the well W in a manner to receive fluid F and gas G therefrom. A fluid and gas separator 16 communicably connects to another end 18 of the upstream flow line 12 in a manner to receive fluid F and gas G flow therefrom. A downstream sales flow line 20 communicably connects to the fluid and gas separator 16 in a manner to receive gas G flow therefrom.

A gas metering device 22 of a provider is commonly operably disposed in the downstream sales flow line 20. A local well site based controller device 100 is operably disposed adjacent the well W and includes a communications device 102. The controller device 100 preferably is a CPU having a processor 101 with an associated memory 103, display 105, keyboard 107 and a suitable power source 109.

Figure 1A:
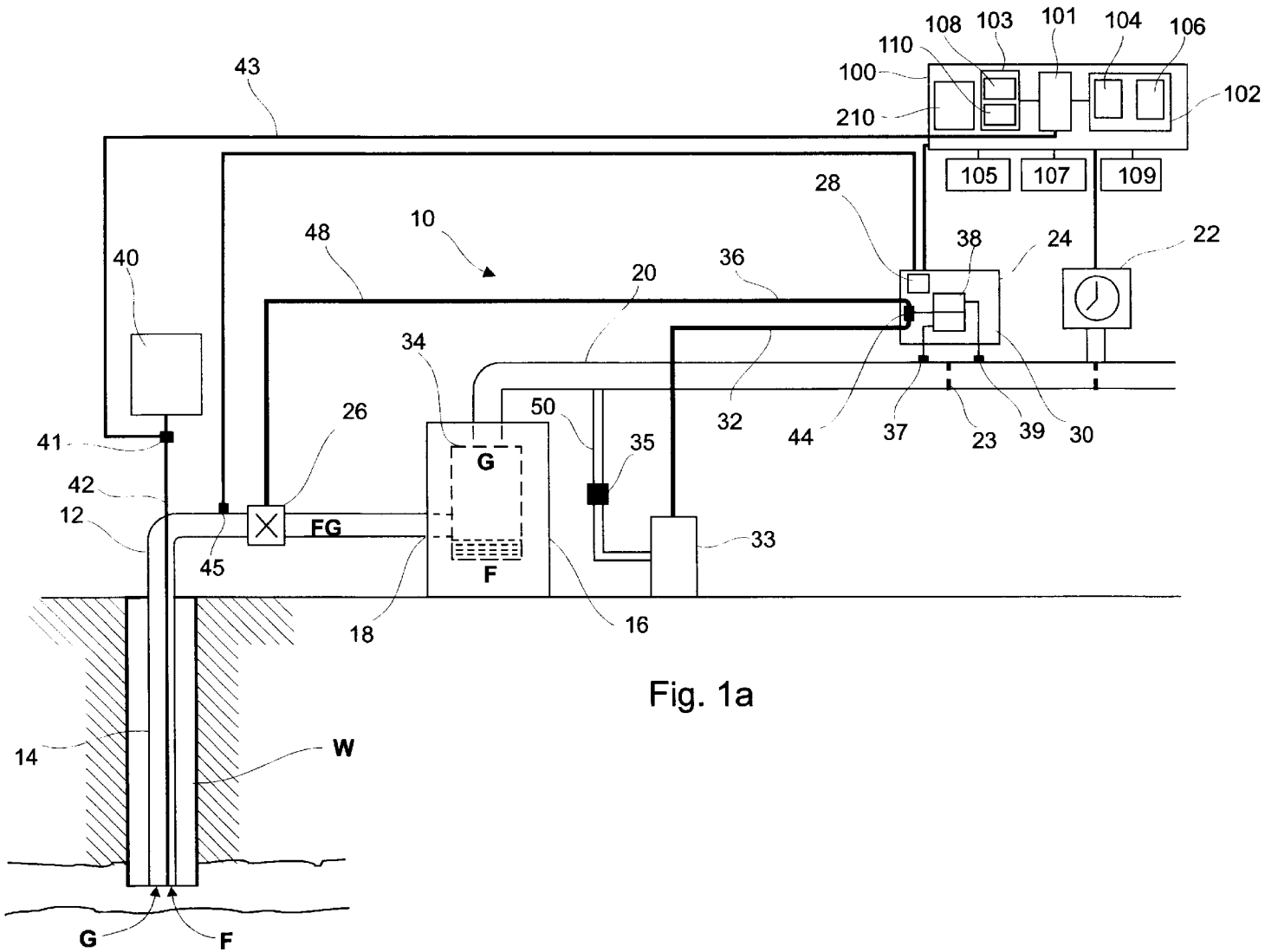
FIG. 1*a* is a schematic diagram of another embodiment of the present invention.
Figure 1B:
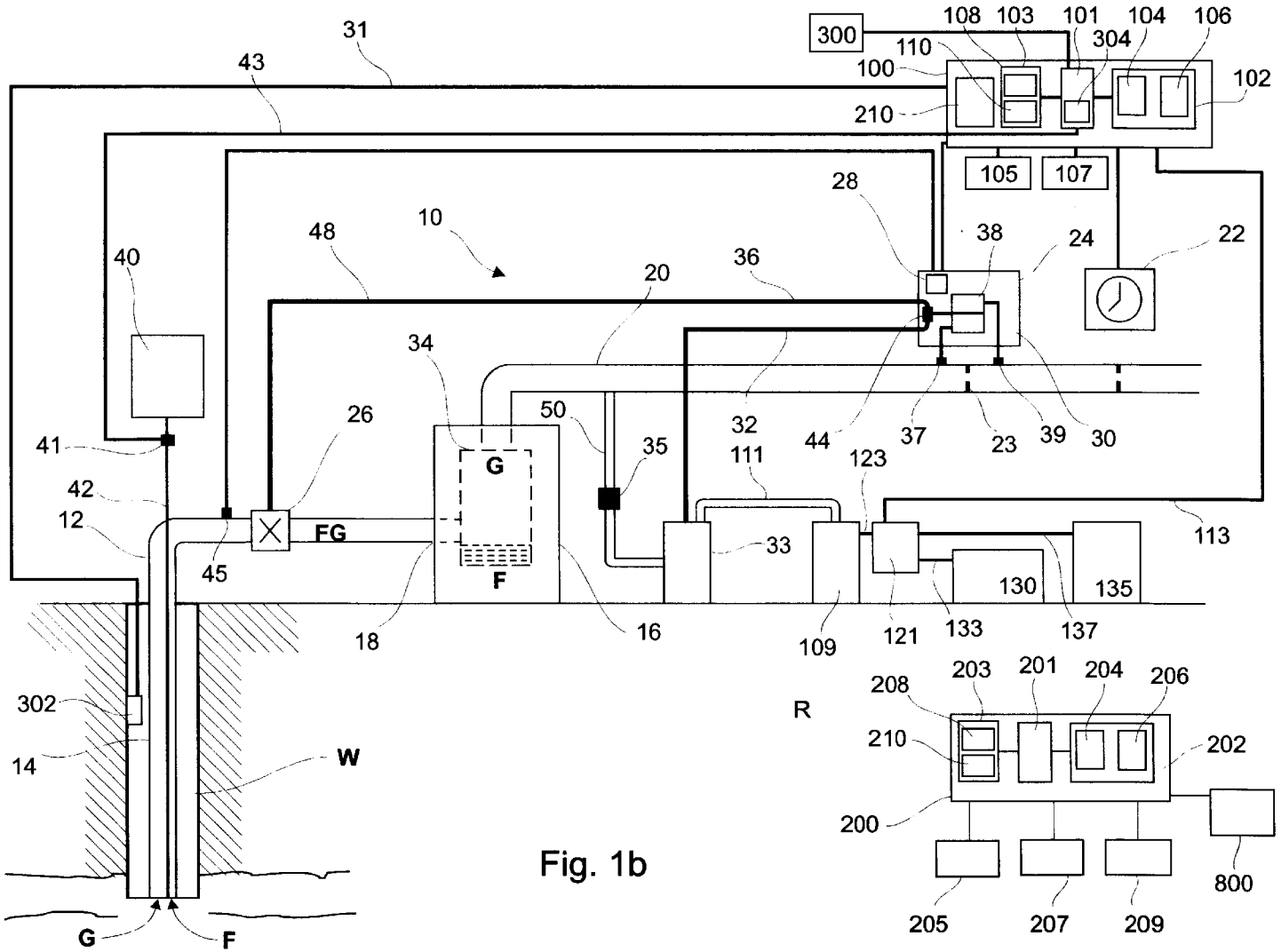
FIG. 1*b* is another schematic diagram of another embodiment of the present invention.

FIG. 1*b* shows the power source 109 which can be a fuel cell which includes a suitable transformer and is operably connected to a scrubber 33 via line 111 and connected to controller 100 via a switch 121 and electrical line 113. The fuel cell 109 includes the means for converting the gas to usable electrical power. The switch 121 provided is operably connected to the fuel cell 109, controller 100, power grid 130 and an on-demand supply delivery unit 135 via electrical lines 123, 113, 133 and 137, respectively.

The communications device 102 includes a transmitter 104 and receiver 106. The controller device 100 has communications software 108 operatively disposed in the memory 103 of the CPU and is operably associated with the receiver 104 and transmitter 106. The controller device 100 includes controller software 110 resident in the memory 103 thereof for performing a variety of functions recited herein and is operably associated with the gas metering device 22, pressure differential control (PDC) 24, communications software 108, processor 101, control valve 41, receiver 104 and transmitter 106.

One function of which the software 110 performs, for example, is to enable gas flow rate detection and generate a transmission signal of the same. It is contemplated that the gas metering device 22 may be either external or integral to the controller device 100. Additionally, the controller device 100 is operably connected to a control valve 26 PDC 24 such that the controller software 110 enables opening and closing the control valve 26 to desired flow. The controller device 100 is preferably housed in a weatherproof casing.

Figure 5:
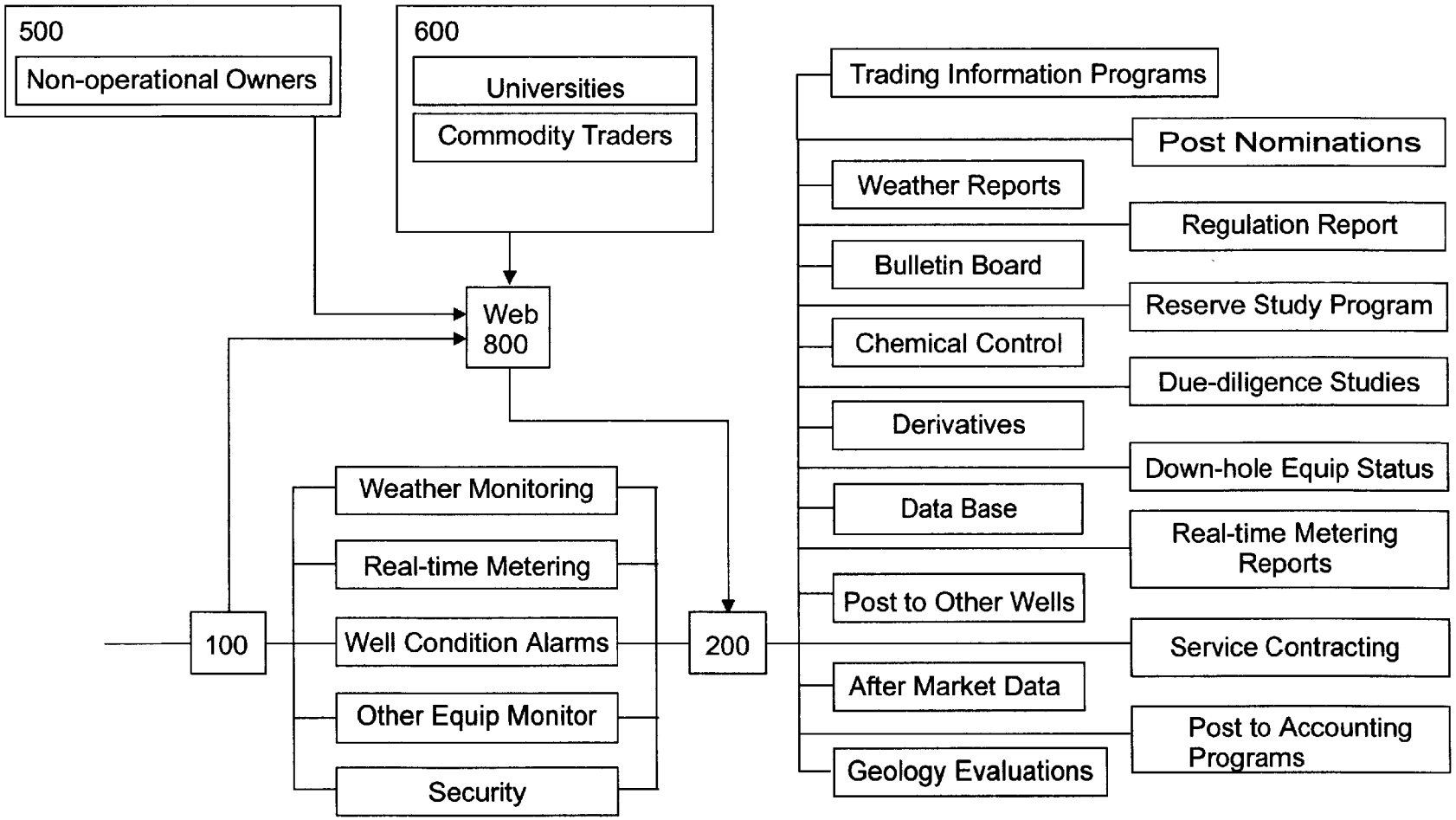
FIG. 5 shows another schematic of the various components interrelating to the web-based system of the present invention.

In addition to the metering capability as discussed and as seen in FIG. 5, the controller 100 is operably connected to means 300 for weather monitoring, means 302 for sensing well conditions and generating and alarm in response to a predetermined alarm condition arising in the well W, and means 304 for monitoring equipment operation and generating a signal is response to a failure and/or service required at the well site.

A remote based controller device 200 is operably disposed at a remote site R and includes a communications device 202. The controller device 200 preferably is a server-client based CPU for enabling web-based clients to access the server CPU and, in turn, the well production information. The controller device 200 has a processor 201 with an associated memory 203, display 205 and keyboard 207 and a suitable power source 209. The communications device 202 includes a transmitter 204 and receiver 206. The controller device 200 has communications software 208 operatively disposed in the memory 203 of the CPU and is operably associated with the receiver 204 and transmitter 206. The communications software 208 is complimentary coded to the communications software 108 to enable communication between the devices 100 and 200. It is contemplated that communication may take place via radio, satellite, cellular tower or convention land line, wherein signals are transmitted between the devices 100 and 200. The controller device 200 includes controller software 210 resident in the memory 203 thereof for remote control of well functions recited herein.

The web-based client server system contemplated in the present invention is depicted is FIG. 5 to provide functions as outlined herein. Through the connections above, controller software 210 in controller 200 is capable of generating, for example, weather reports at the well site, as well as reports relating to chemical requirements, down-hole status, real-time metering data, service contracting, bulletin board information, trading information and programs, regulations requirement data, geology evaluations data, derivatives data, reserve studies data, and due diligence, as well as the ability to post nominations and post to accounting. The information gathered and generated via the controller 200 can be part of a database which resides in the memory 203 of the controller 200.

Figure 4:
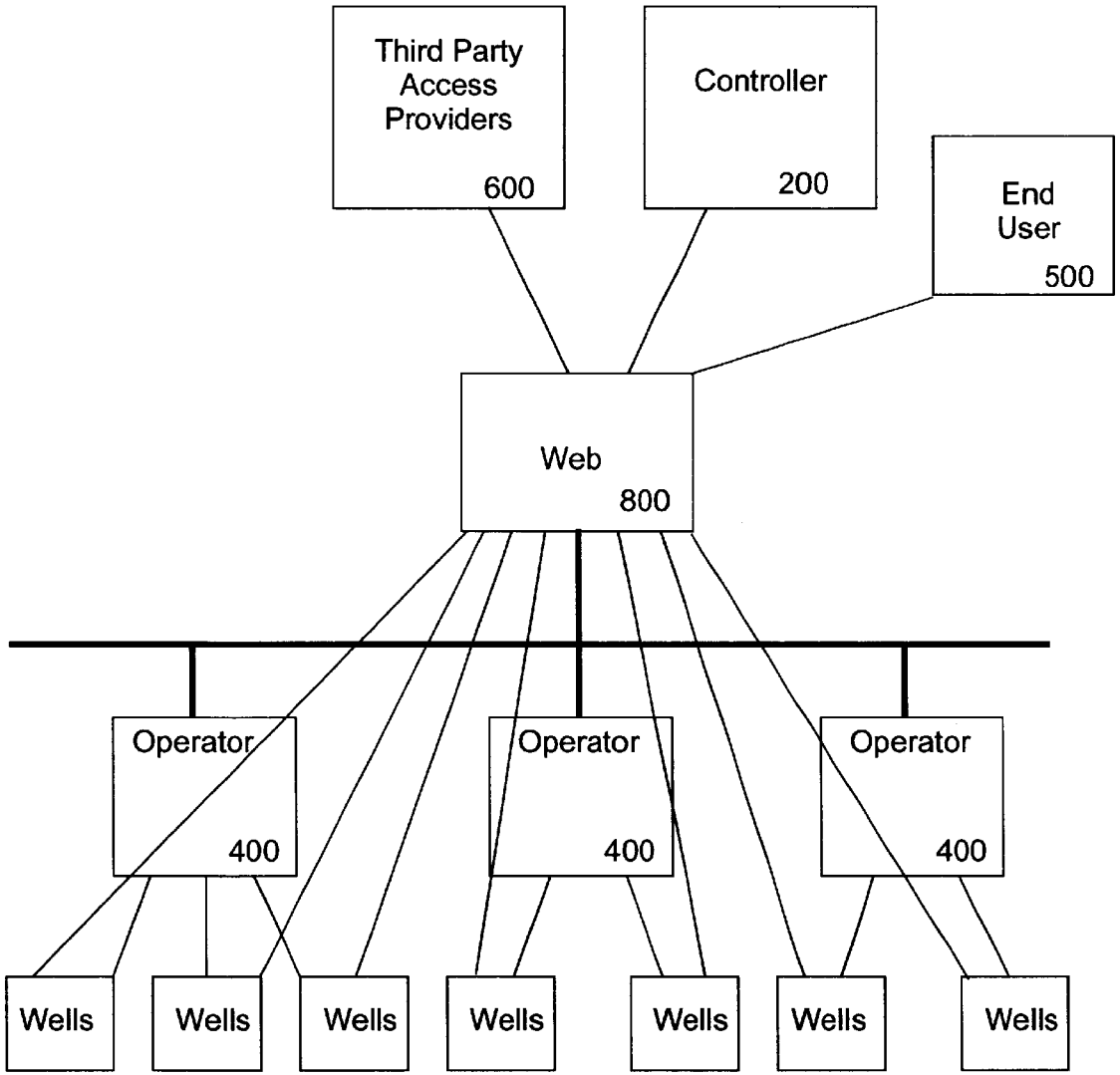
FIG. 4 shows a diagram of the web-based client-server control.
Figure 4A:
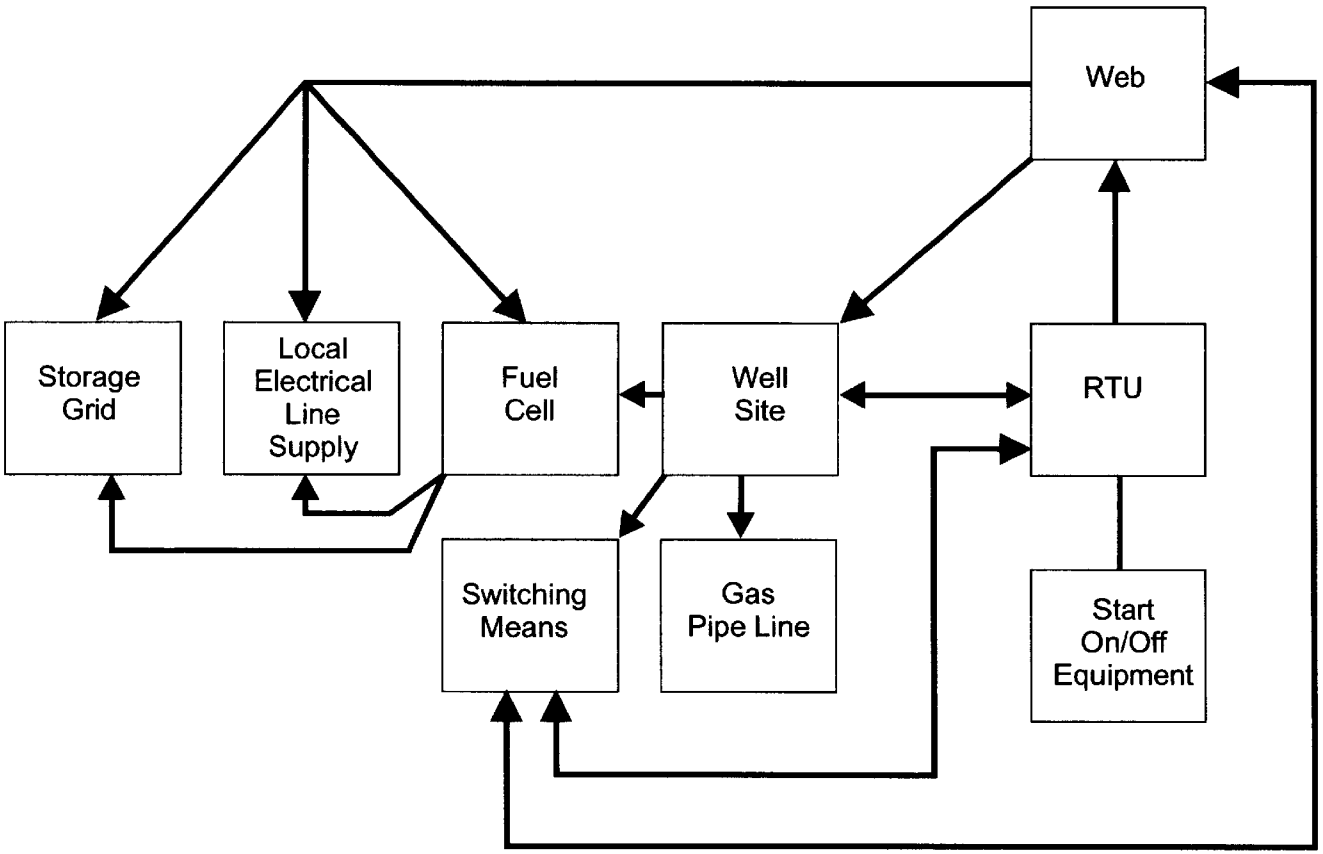
FIG. 4*a* shows a diagram of the web-based control of the well.

The controller 200 will preferably host data from a significant number of wells W as depicted in FIG. 4. The database may be accessed though the web 800 by third parties 600, including, but not limited to universities and traders, end users 400 (including power grids and or local site use, e.g., controller at well head) and non operational owners 500. The access is preferably limited to particular purpose(s) with respect to type of party entering the database. For example, a party which subscribes to access the controller 200 for the purpose of obtaining on-demand power, may have restricted access to certain wells W which such entity can control the amount of power on an as needed basis. The controller software 210 includes software means for tracking and logging such usage for purposes of accounting and billing such entity. The controller software 210 and controller software 110 control switch means 121 to direct the flow of power and or fuel to a desired path and in a desired amount.

By way of a functional example via the connections recited above, the controller device 100 transmits flow rates in the downstream sales flow line 20 to the controller device 200. The controller device 200 includes flow analysis in control software 210 resident in the memory 203 of the CPU which upon receiving the flow rate signals, manipulates the flow rate signals to produce optimum well shut in and flow periods. The flow analysis in control software 210 monitors flow rate signals over a predetermined period wherein a peak flow rate is observed after the well W has been shut in for a period of time, e.g., several hours. The controller device 200 transmits a signal to the controller device 100 causing the control valve 26 to close and shut in the well W for a predetermined period. After the predetermined period of time, the controller device 200 transmits a signal to the controller device 100 to cause the control valve 26 to open. Flow rates are sensed by the controller device 100 and transmitted to the controller device 200. Peak flow rate and minimum flow rate are observed by the flow analysis and control software 210. When the flow rate drops below a predetermined level, the well W the flow analysis and control software 210 causes the controller device 200 to transmit a signal to the controller device 100 to shut in the well W and the pressure is allowed to build in the well W. This process is repeated and the flow analysis and control software 210 learns the optimum shut in time in order to achieve maximum peak flow rates. Also, the flow analysis and control software 210 learns the diminished flow rates of the well W.

Figure 2:
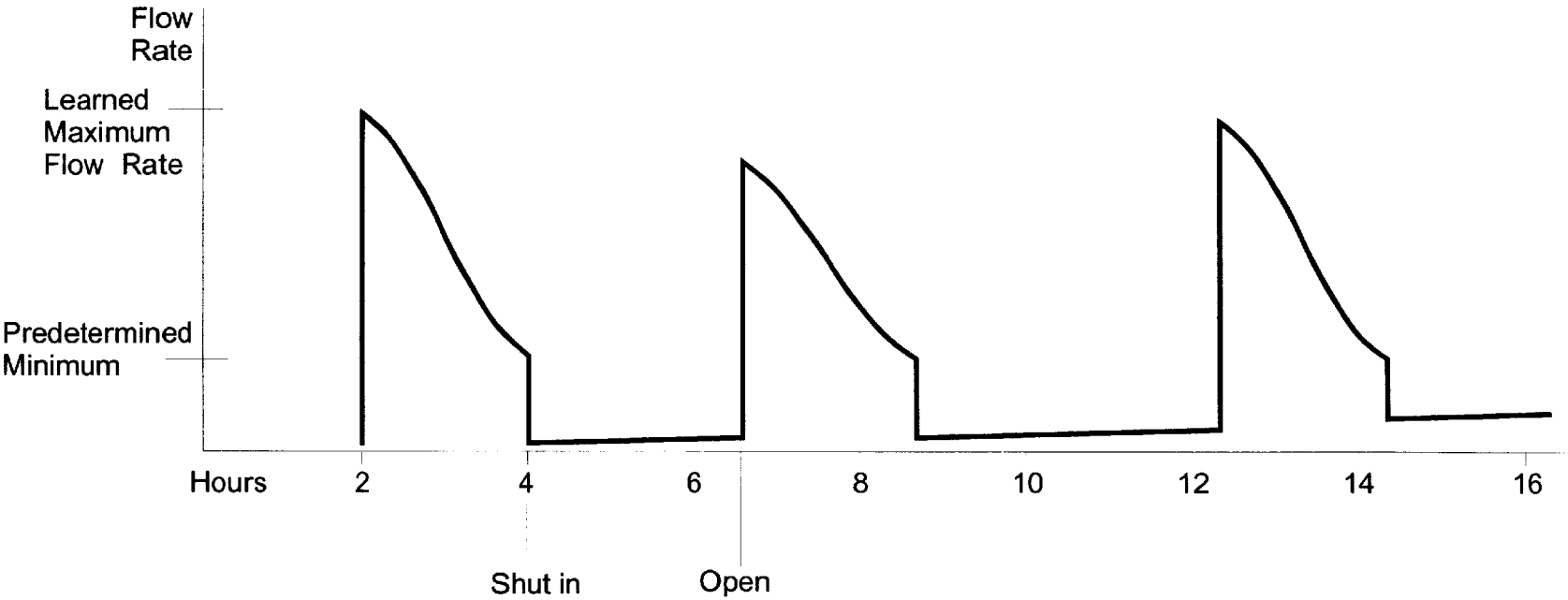
FIG. 2 is a graphical representation of the flow patterns of a well for a given period under a earning phase employing the present invention.

This learning process is depicted in FIG. 2 wherein the well W is shut in using different time periods until the maximum flow rate is achieved. Once learned, the flow analysis and control software 210 causes the controller device 200 to transmit a signal to the controller device 100 to fix the shut-in and open times in accordance with the learned maximum rate and minimum flow rate. The controller device 100 thereafter periodically transmits flow rate signals to the controller device 200 for purposes of determining the production of the well W and further attenuation using the flow analysis and control software 210

While the flow analysis and control software 210 is depicted on the remote controller device 200, it is contemplated that the same can be integrated into the controller device 100 as seen in FIG. 1*a*. However, the remote site controller device 200 is employed as it will serve as a hub which will control a large number of wells W from a common site and act as a real time data host for information transfer and display and web server host.

The invention also includes a restricted region or orifice 23 which is formed in the downstream sales flow line 20. PDC 24 is operably associated with the downstream sales flow line 20 between the gas metering device 22 and the fluid and gas separator 16 and is shown in one aspect for sensing pressure differential in the downstream sales flow line 20 about the orifice 23. The control valve 26 is operably disposed in the upstream flow line 12 and is operably controllably connected to the PDC 24 in a manner to permit regulated flow through the upstream flow line 12 at a predetermined amount in response to the sensed pressure differential. Optionally, the PDC 24 may include a timer device 28 which can also be used alone or in combination to control the control valve 26 to restrict and open at a predetermined time in accordance with the predetermined flow characteristics of the well W, i.e. its natural flow rate. The controller device 100 is operably connected to the PDC 24 and can employ the use of a controlled transfer valve 44 hereinafter described to open an close the control valve 26. It is also recognized that the controller device 100 may be directly connected to control valve 26 employing either pneumatic or electrical means for operation thereof. Optionally, the PDC 24 may be connected to another pressure sensor 45 or on downstream line 20 about an orifice at the custody transfer station at meter 22 or on the upstream flow line 12 which may be used in establishing the predetermined flow characteristics of the well W.

The PDC 24 is equipped with means 30 for sensing the pressure differential. The sensing means 30 can be mechanically or electrically based. In this regard, the sensing means 30 is operably connected to either the separator 16 or the controlled transfer valve 44 which is connected to one end 36 of a line 48 which sends a supply gas as a signal to the inlet control valve 26 for operation thereof. This supply gas emanates from a line 32 which is operably connected to a scrubber 33. The scrubber 33 is in turn operatively connected to a line 50 having a regulator 35 therein. The line 50 is operably connected to the downstream flow line 20 to receive gas therefrom. The sensing means 30 includes a pressure transducer 38 which is operably connected to the downstream sales flow line 20 having two pressure sensors 37 and 39 operably employed on the downstream flow line 20 about the orifice 23 in order to sense the amount of pressure differential about the orifice 23. While the components can be mechanical or electrical to carry out the function of the sensing means 30, electrical is preferred so that signals readings can be electronically transferred to the controller 200. The components aid to regulate the supply of gas in the downstream flow line 20.

Figure 3:
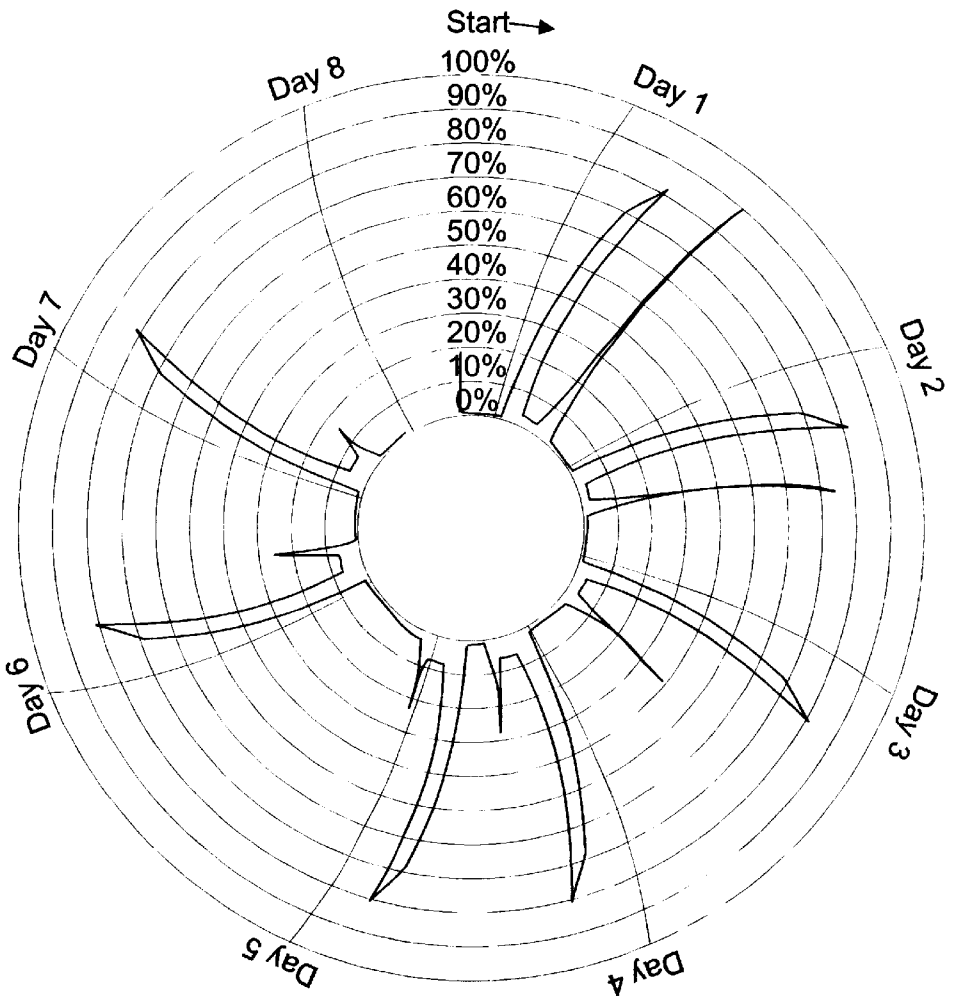
FIG. 3 is a graphical representation of the flow patterns of a well for a given period.

As the PDC 24 senses pressure differentials above or below a predetermined threshold range, the PDC 24 sends a supply signal to the control valve 26 via a transfer valve 44 causing it to restrict or open accordingly. For example, when fluids F and gas G are flowing in the upstream flow line 12, and the flow of gas G decreases, then flow decreases in the downstream sales flow line 20. The PDC 24 senses the decrease in gas G flow and further opens the control valve 26. This enables fluids F and gas G to enter the separator 16 faster and reduces back-pressure in the well W which would normally cause fluids F to fall back down the well W. Without this immediate and preferably automatic opening of the control valve 26 which relieves this condition, the fluids F would begin falling back into the well W before reaching the surface. Conversely, as flow in the upstream flow line 12 increases, flow in the downstream sales flow line 20 increases which initiates the PDC 24 to actuate the control valve 24 to restrict, thus keeping the flow conditions at an optimum to lift fluids F and for a longer period and also prevent over-ranging the meter 22. This volume flow control keeps gas G at a rate which is not too fast or slow, but sufficient provide lift of the fluid F. Optimal flow can be achieved and is reflected in FIG. 3.

It is important to note that if the proper flow rates are not maintained, the fluids tend to lay against the tubing wall and won't come to the surface. As previously stated, the natural flow rate can be determined as described above as a function of a particular well's original natural geological characteristics and this flow rate is what is ideally attempted to be maintained by the PDC 24.

Since the gas G expands as it moves toward the surface of the well W, the fluid F is necessarily drawn to the top with the gas G and the rate is necessarily a function of the gas G maintained in the fluid F. The separator 16 affects the optimal recovery by virtue of separating the gas G from the fluid F. Accordingly, an aim of the invention is to maintain an acceptable flow rate which optimally promotes fluid F and gas G flow in a manner which avoids the deleterious effects of spiking caused by restricting flow of the well W. The PDC 24 thus is employed in the present invention to keep the flow rate in the predefined measurable range within the down stream sales flow line 20.

Additionally, chemical and biochemical additives 40 can be added to further enhance recovery production. Such additives 40 can be liquid or solid type, such as microorganisms, foaming agents or viscosity modifiers which are delivered to the bottom of the well W by a tubing 42, for example. This injection string of tubing 42 can be sized so it will displace part of the flow capacity which permits the siphoning action or critical flow rates to be created with less force in the well formation than would be required in a more productive well. An electrically operated control valve 41 is disposed within the tubing 42 and is operably connected to the controller device 100 and processor 101 via an electrical line 43. The controller device 200 can also control the operation of adding additives 40 from the remote site R via flow analysis and control software 210.

In another aspect of the invention, this well W production information is transmitted by the controller device 200 to an Internet web site 800 wherein the production information is posted for purposes of sale. Prior hereto, marginal well owners were forced to deal with third party marketers which bought the well production at a low cost, pooled a group of wells and sold the production to the consumer. Now, owners of one or a few marginal wells can sell their production on an equal footing with large producers and gain comparable market rate as large producers while providing the consumer a potentially lower cost of goods.

As depicted in FIGS. 4 and 5, the operators 400, application service providers 500, end users 600 and/or Wells W can link to the controller 200 through the web 800. It is understood that the link through the Web 800 is in-part via controller 100 at the well W. Operators 400 of a group of wells W can directly or indirectly feed information from the wells W to the controller 200 via the Web 800.

The method of the present invention includes the steps of controllably delivering fluid and gas from a well in a single inlet flow path to a separator, separating the fluid from the gas into to separate outlet flow paths from the separator, sensing flow rate in the gas outlet flow path, employing a controller device to determine peak flow rate, diminished flow rate and optimal shut in period and open period of the well. The method also includes comparatively sensing pressure of gas in the outflow path about a restricted region in a downstream sales flow line, and controllably regulating flow rate of the fluid and the gas in the inlet path in response to the sensed pressures. Additionally, pressure is sensed by sensor 45 in the upstream flow line or timed controlled of the flow restriction can be employed to control the proper pressure for obtaining optimal flow conditions. Additionally, the method further includes the adding of a flow enhancing additive to the well.

The method further includes remote controlling fluid and gas from the well W through a web based server-client system. The system is preferably access protected.

By so providing the present invention, there is realized enhanced recovery of fluid and gas. The present invention provides for an enhanced method and apparatus for controlling the metered gas which is recovered. The present invention provides for a new mechanism by which marginal well gas can be marketed and sold with greatest efficiency.

The above described embodiment is set forth by way of example and is not for the purpose of limiting the present invention. It will be readily apparent to those skilled in the art that obvious modifications, derivations and variations can be made to the embodiments without departing from the scope of the invention. Accordingly, the claims appended hereto should be read in their full scope including any such modifications, derivations and variations.

What is claimed is:

1. A web-based apparatus for enhancing fluid and gas flow in a well, which includes:

an upstream flow line communicably connected at one end to the well in a manner to receive fluid and gas therefrom;

a fluid and gas separator communicably connected to another end of said upstream flow line in a manner to receive fluid and gas flow therefrom;

a downstream sales flow line communicably connected to said fluid and gas separator in a manner to receive gas flow therefrom;

a control valve operably disposed in the upstream flow line; and means for sensing flow rate in at least one of said flow lines;

means operably associated with said sensing means for determining peak flow rate and minimum flow rate and generating an optimum shut-in period and flow period for the well;

a local controller operably associated with said determining means for controlling said control valve in a manner to permit regulated flow through said upstream flow line in accordance with said optimum shut-in period and flow period, wherein said local controller has a communications device associated therewith; and a web-based remote controller device operably controllably connected to said local controller having a communications device therewith, wherein the said local controller device and web-based remote controller device communicate with one another to enable web-based remote control of the control valve.

2. The apparatus of claim 1, which further includes a pressure differential control operably disposed in the downstream sales line for comparatively sensing pressure differential in the downstream sales line about a restricted region in the downstream sales flow line and which is operably controllably connected to said controlling means in a manner to regulate flow through said upstream flow line at a predetermined amount in response to the sensed pressure differential.

3. The apparatus of claim 1, which further includes means operably connected to said local controller for introducing fluid flow enhancing additives into the well.

* * * * *